United States Patent [19]

Liclican

[11] 4,019,728

[45] Apr. 26, 1977

[54] APPARATUS AND SHINGLED STRIP FORMED THEREFROM

[76] Inventor: Rafael A. Liclican, 160 Kamias Road, Quezon City, Philippines

[22] Filed: Aug. 1, 1974

[21] Appl. No.: 493,948

[30] Foreign Application Priority Data

Aug. 10, 1973 Philippines ..... 14898

[52] U.S. Cl. ..... 270/58; 270/53

[51] Int. Cl.² ..... B65H 39/02

[58] Field of Search ..... 270/54, 58, 53; 156/517, 519, 552, 557

[56] References Cited

UNITED STATES PATENTS

| | | | |
|---|---|---|---|
| 2,476,250 | 7/1949 | Paulsen | 270/58 |
| 2,627,406 | 2/1953 | Mestre | 270/58 |
| 2,640,695 | 6/1953 | Nelson | 270/58 |
| 3,565,728 | 2/1971 | Alton | 156/519 X |

*Primary Examiner*—Edgar S. Burr
*Assistant Examiner*—S. Heinz
*Attorney, Agent, or Firm*—Sughrue, Rothwell, Mion, Zinn & Macpeak

[57] ABSTRACT

This invention relates to shingle-like assembly to facilitate the listing phase of bookkeeping, invoice processing or any other data processing operation. A plurality of strips are arranged in edge-to-edge connection to form the shingle of predetermined length. Apparatus for making the shingled strip is also disclosed wherein a tape is fed from a supply magazine into a bonding zone where a layer of adhesive is applied to one side of the tape. The tape is then passed beneath a magazine filled with strips and each strip is edge bonded to the tape. The position of the strip magazine is adjustable to vary spacing between the strips.

8 Claims, 7 Drawing Figures

APPARATUS AND SHINGLED STRIP FORMED THEREFROM

This invention relates to data processing and more particularly to a plurality of strips and the apparatus to arrange said strips in an edge- to- edge connection in accordance to a predetermined spatial relationship to thereby form a shingle of pre-determined length from the said plurality of strips. The shingled strip of this invention though not limited thereto finds particular application in a data processing system disclosed in my Phillippines Pat. No. 6612 issued on Apr. 26, 1972.

Heretofore, progressive and fast growing companies are usually confronted in their data processing with two major problems. Firstly, the increase in the frequency and volume of business transactions have reached the practical limit of the old bookkeeping system- a manual method of financial data processing with the use of special columnar, journals and ledgers. This situation have caused substantial delays in the submission of financial reports thereby defeating its usefulness and have caused numerous errors inevitable in nature that sometimes make such periodic financial reports unreliable.

Secondly, the control of a company's growing operation gets more complicated and the modern management technique (budget system is one of them) demand early availability of more detailed and more sophisticated financial information at short periodic interval on the status and result of operation not only on the totality of the business as a whole but more vital are the status and result individually of the multi-farious activities of a company. Management of such companies consider these more specific and detailed financial information as imperative to simplify the control of a company's profitable operation.

Numerous improvements have been developed to solve these major problems of data processing. The most popular are:

A. The punched card system with the use of key punched machine known as computer process;

B. Electrically operated electronic accounting machines popularly known as the "mini-computer."

The computer practically can give all the solution to any data processing problems. Unfortunately, however, its operating costs is so prohibitive that the benefits it offer can be afforded only by a very limited few.

All improvements in financial data processing has one common denominator. That is the realization of the benefit is dependent on a machine which requires a very substantial capital outlay. Furthermore, with the exception of the computer, all innovations retains the posting routine of the bookkeeping system. This routine entails selection of a ledger from a file for every item or data to be posted. This phase represent the bulk of the bookkeeping process and the worst about it is that, it is the source of all the processing mistakes that error-finding routines further lengthen the processing time.

The instant invention contemplates the use of shingled strips in the listing phase of bookkeeping, invoice processing or any data processing system to permit the data listed to be sorted by classification with the strip thereby making possible an uninterrupted or continuous listing of all the data for a classification or category. This eliminates the selection and handling of the ledger or classification for every data to be posted or listed in such ledger. It also eliminates the bulk of committing error since sorted strip is a duplicate of the listing process which is proven accurate.

Most important is that the listing provide control totals which should also be the grand total of all the total of the classified data in the ledger. The shingled strip further make flexible the bookkeeping process that should summary is preferred to be produced, first taping or totaling the sorted strip will be sufficient to produce summary without even listing them to the ledger.

It is therefore a principal object of this invention to provide a shingled strip for a data processing system which will enable processing of data to be accomplished at definitely lower cost than heretofore, economy being evident not only due to efficiency but also in the original cost of materials.

Another object of the invention is to provide a fabricated shingled strip of such character that it lends itself to automation with a noticeably increased rate of production.

A further object of the invention is to provide a simple, flexible and effective data processing to enable data processor of a business concern to produce specific and detailed financial information required by management in evaluating the company's profitable operation.

The foregoing advantages, objects, salient features and other in addition to those that will become apparent to persons skilled in the art will be clearly discernable upon reading of the following specification when considered in connection with the accompanying drawing wherein.

Figure 1:
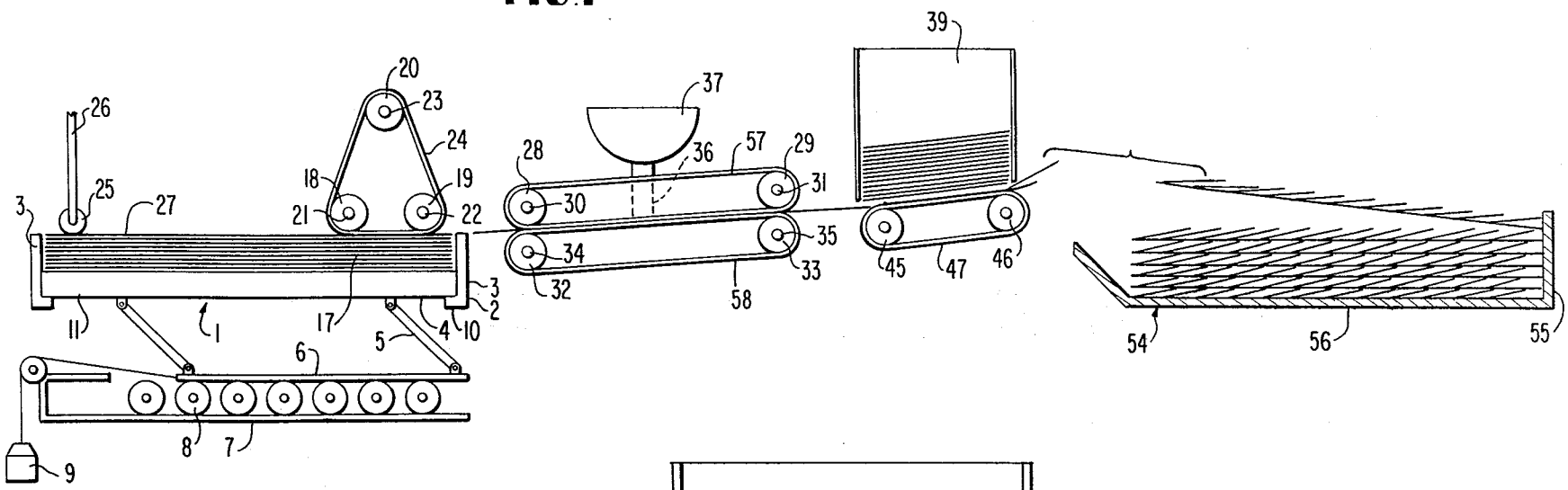
FIG. 1 is a segmental diagrammatic view of a shingled strip forming apparatus embodying the invention.

As shown in the drawing, the illustrated apparatus comprises a tape zone; a bonding zone; a shingling zone; and a stacking zone.

The tape zone comprises of a supporting device 1 that cooperates with tray 2 and a pair of guide members 3 to provide a magazine for a plurality of tapes that have been cut to predetermined sizes. The supporting device 1 comprises a supporting block 4 having depending legs 5 extending therefrom toward the mounting frames 6 disposed longitudinally of the base structure 7 through relatively spaced apart transverse rollers 8. The mounting frames are hingedly connected to the end portion of the legs 5 and are longitudinally slidable through the rollers 8 whereby the counter weight 9 may be moved downwardly and away from the base structure 7. Upstanding guide members 3 are provided further with anchoring tabs 10 respectively disposed to engage the inner surface of block 4 as indicated at 11.

Figure 3:
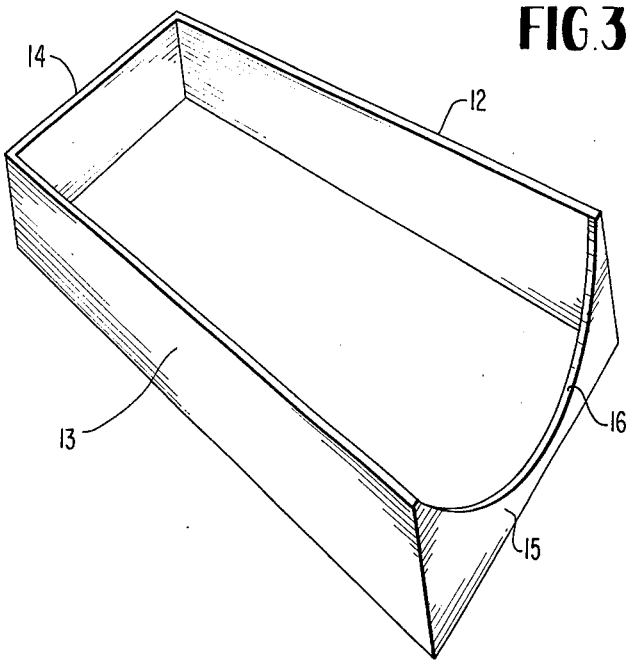
FIG. 3 is a perspective view of the tape tray.
Figure 5:
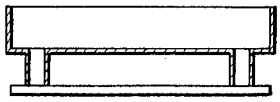
FIG. 5 is a cross sectional view of the adhesive applicator.

Mounted contiguous with the supporting block 4 and held in functional communication thereto is a tray 2 (FIG. 3) that consists of a longitudinal housing which defines a pair of longitudinal sides walls 12, 13 and a pair of transverse walls 14, 15. Transverse wall 15 is largely cut at the top portion thereof and thereby provide an arcuate portion 16 to enable the tape sheets 17 to be discharged therethrough flawlessly.

The aforementioned magazine is further defined by a plurality of rollers 18, 19, 20 that are mounted on horizontal shafts 21, 22, 23 disposed transversely of tray 2. Rollers 18, 19, 20 are fixedly spaced relative to each other and wrapped together by a conveying belt 24 that is preferably made of friction material. Lateral adjustments of rollers 18, 19 can be effected by adjusting roller 20 laterally along its conventional shaft support in a manner well known to those skilled in the art. To make for positive maintenance of tape level a roller 25 guided by a rod 26 is mounted adjacent the transverse wall 14. Roller 25 may rock about the axis of rod 26 to maintain the tape sheets in extensive surface contact therewith and the conveying belt 24.

It should be understood that conveying belt 24 together with roller 25 are urged in an upward direction by supporting block 4 that is disposed in coextensive surface engagement with bottom sheet 27 of the plurality of tapes. In like manner the upward movement of the block 4 is limited by the engagement of roller 25 and conveying belt 24 with the trailing and leading portions respectively of the topmost sheet 17 so that upon discharge of said topmost sheet, the supporting block 4 moves upward by a space equal to the thickness of said sheet 17.

Figure 2:
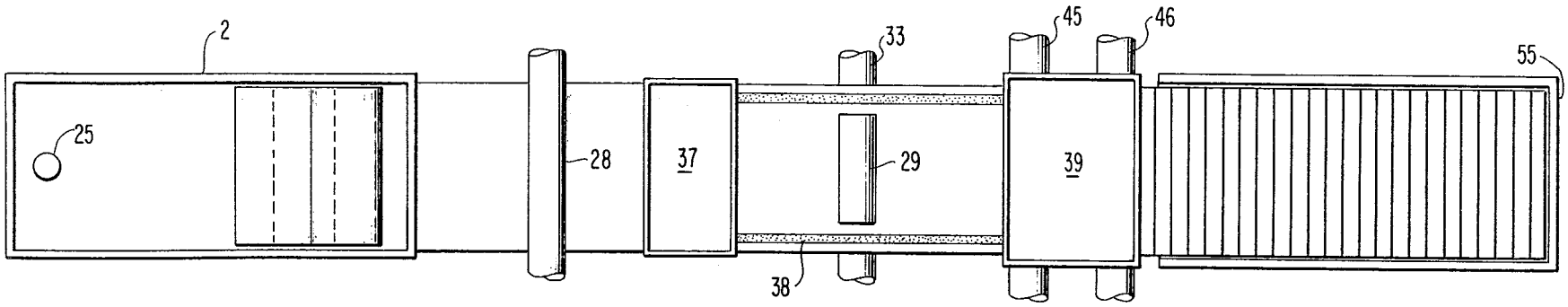
FIG. 2 is a top plan view thereof.

The bonding zone comprises a feeding means and a bonding material applicator. The feeding means for the sheet consists of roller 28, 29 mounted on a horizontally disposed transverse shaft 30, 31 and overlying a like plurality of pressure roller 32, 33 mounted on horizontally disposed transverse shafts 34, 35. Rollers 32, 33 with conveying belt 57 wrapped therearound cooperates with rollers 29, 30 with belt 58 in bringing the tape sheet into underlying position with duct 36 of reservoir 37. The duct 36 may be provided with a wick and engages the surface of the sheet to apply thereon a row of bonding material as indicated at 38 in FIG. 2.

Figure 4:
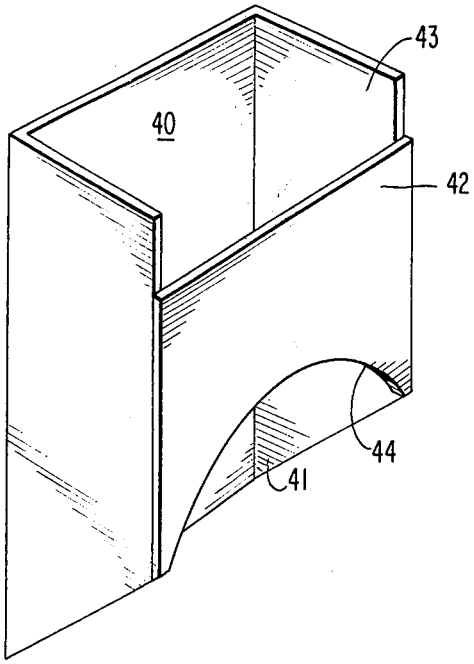
FIG. 4 is a perspective view of the strip magazine.

The shingling zone has as its principal member a strip magazine 39 (FIG. 4) substantially of rectangular construction, the magazine has four upstanding walls and open at the top 40 and bottom 41. Side wall 42 is largely recessed from the topmost portion to provide an opening 43 thereat for receiving a renewing charge of strips while the bottom portion thereof is largely cut to provide an arcuate portion 44 for providing an allowance thereat an allowance to the trajectory flight of the shingled strip upon discharge.

As shown in FIG. 1, a pair of feed roller 45, 46 are provided to underlie the magazine 39. Conveying belt 47 preferably of friction material endlessly extends around rollers 45, 46 and the lateral surface therebetween corresponds to the contour of the bottom 1 of the magazine 39.

Figure 7:
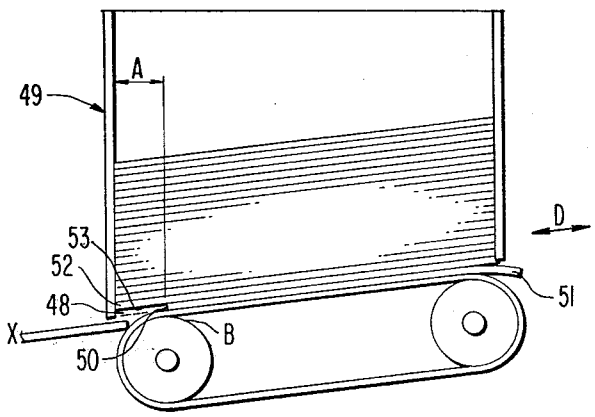
FIG. 7 is a blow-up illustration of the shingling of strips.
Figure 6:
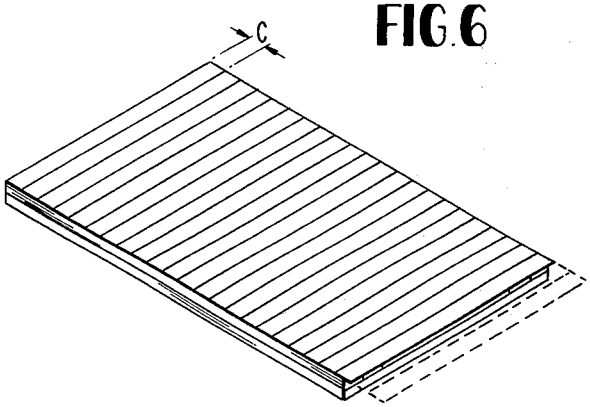
FIG. 6 is a perspective view of a shingled strip.

The spatial arrangement of strips that form a shingle (FIG. 6) is greatly associated with an adjustment of the magazine 39. This is evidently clear, when attention is focused on the operation of roller 45 neglecting for a moment roller 46 since the two rotate uniformly. As shown in FIG. 1 and FIG. 7 the plurality of strips in magazine 39 are held in position by the extensive surface to surface engagement of the strip and the upper portion of belt 47 while lateral sliding is restricted by edge 48 of the sidewall 49. As the tape X abuts the peripheral surface of the belt 47 at roller 45 edge 50 of the sheet 51 has already traveled a distance A from the edge 48 to the point (B) where edge 50 is tangent to the peripheral surface of belt 47. This movement of sheet 51 creates between belt 47 and the succeeding strip 52 a spatial clearance equal to the thickness of the sheet 51. This clearance is eventually filled by the tape X as the rotation of roller 45 continuous and the edges 53 of strip 52 will now be bonded to the tape (X) at exactly the point of tangency.

With a view to modify the spacing (C) between strips (FIG. 6) as produced when the strip comes into contact with the tape, the magazine 39 holding said strip is carried parallel to the contour of belt 47 by a conventional attachment well known to persons skilled in the art. Thus, by causing the magazine 39 to move laterally parallel to the plane of belt 47 as indicated in arrow (D) it is possible to shorten or lengthen the distance between strip to satisfy spatial entry requirement of the master record sheet with which the shingled strip has to be interrelated.

Extending longitudinally outwardly beyond the shingling zone is the shingled strip receiving tray 54 that consists of a longitudinal housing which define a backplate 55 for edgewise reception of shingled strip as they are received and a platform 56 for surface engagement with the first delivered shingled strip. In this connection it may be emphasized that the primary consideration for making the width of the tape equal to that of the strip is to eliminate wedge formations or margins that will unduly interfere with the filing.

The rotative power to drive the different rollers of the apparatus is taken from one electric motor of the variable speed type. Since the characteristic of said motor together with the construction of a single drive system are well known in the art, the details thereof were omitted hereinbefore and only the explanations necessary for describing the invention were given.

In a general manner, while I have, in the above description, disclosed what I deem to be practical and efficient embodiment of my invention, it should be well understood that I do not wish to be limited thereto as there might be changes made in the arrangement, disposition and form of the parts without departing from the principles of the present invention as comprehened within the scope of the accompanying claims.

I claim:

1. An apparatus for the manufacture of a shingled strip comprising:

a. a stack of tape sheets (17) supported on a supporting block (4);

b. a plurality of guide members (3) slidably supporting said supporting block (4);

c. at least one mounting frame (6);

d. a plurality of legs (5) pivotally connected to the supporting block (4) and the at least one mounting frame (6);

e. a stationary base structure (7);

f. a plurality of rollers (8) engaging said base structure (7) and the at least one mounting frame (6) such that the mounting frame (6) is movable relative to the base structure (7); movement of the mounting frame (6) causing the supporting block (4) and stack of tape sheets (17) to move upwardly;

g. belt means engaging the uppermost tape sheet on the stack of tape sheets such that movement of said belt means removes the uppermost tape sheet from the stack;

h. bonding material applicating means (36, 37) to apply a bonding material to at least a portion of the tape sheet removed from said stack;

i. first feeding means to feed said tape sheet from said belt means to said applicating means;

j. a shingle strip magazine (39) containing a stack of shingle strips to be affixed to the tape sheet;

k. second feeding means to feed the tape sheet from said first feeding means to said shingle strip magazine, said second feeding means positioned relative to said strip magazine such that the strips have one edge attached to the tape sheet by the bonding material as the sheet passes said magazine; and l. means to store the completed shingled strips.

2. An apparatus as in claim 1 wherein the belt means for removing said tape sheet from the stack comprises: a plurality of rollers (20-22), each of said rollers being mounted transversely of said stack, the rollers arranged in a triangular configuration; an endless belt extending around said rollers, a portion of the belt engaging the uppermost tape sheet; and a roller (25), supported on a rod extending toward the stack, said roller being held in surface contact with the uppermost tape sheet by the upward movement of the supporting block (4).

3. An apparatus as in claim 2 wherein the bonding material applicating means comprises a reservoir (37) having semicircular cross-section and a pair of spaced apart ducts provided at the bottom of said reservoir to place the bonding material on the tape sheet.

4. An apparatus as in claim 3 wherein the first feeding means comprises: two pair of transverse shafts (30, 31; 34, 35); a roller (28, 29, 32, 33) mounted on each shaft; endless belts (57, 58) of friction material extending around each pair of rollers; means to drive said rollers at a uniform speed to feed the tape sheet into underlying position with the duct (36) of said bonding material applicating means.

5. An apparatus as in claim 4 wherein the shingled strip magazine (39) comprises four walls with open top and bottom portions, one of said walls (42) being recessed at the topmost portion thereof for providing an opening to receive fresh charge of strips, said wall (42) also having an arcuate cutout provided at the bottom portion thereof so as to facilitate removal of the shingled strips.

6. An apparatus as in claim 5 wherein second feeding means comprises: a pair of spaced apart transverse shafts located in a plane parallel to the bottom of said shingled strip magazine; a roller (45, 46) mounted on each of said transverse shafts; and an endless belt (47) extending around said rollers and defining therewith a bottom member of said strip magazine.

7. An apparatus as in claim 6 wherein one of said shafts is located subjacent the other; and further comprising means to adjust the magazine with respect to said rollers for modifying the spatial distances of each strip in the shingled strip.

8. An apparatus as in claim 7 wherein the means for storing the completed shingled strips comprises a tray (54) having a backplate (55) and a platform (56) for surface to surface engagement of each shingled strip.

* * * * *